US008827829B2

(12) United States Patent
Nakano

(10) Patent No.: US 8,827,829 B2
(45) Date of Patent: Sep. 9, 2014

(54) GOLF CLUB SHAFT

(75) Inventor: Takashi Nakano, Kobe (JP)

(73) Assignee: Dunlop Sports Co. Ltd., Kobe (JP)

( * ) Notice: Subject to any disclaimer, the term of this patent is extended or adjusted under 35 U.S.C. 154(b) by 219 days.

(21) Appl. No.: 13/483,631

(22) Filed: May 30, 2012

(65) Prior Publication Data

US 2012/0309558 A1 Dec. 6, 2012

(30) Foreign Application Priority Data

May 31, 2011 (JP) ..... 2011-121471

(51) Int. Cl.
*A63B 53/10* (2006.01)

(52) U.S. Cl.
USPC ..... 473/319

(58) Field of Classification Search
USPC ..... 473/316–323, 292
See application file for complete search history.

(56) References Cited

U.S. PATENT DOCUMENTS

| | | | | |
|---|---|---|---|---|
| 5,265,872 | A * | 11/1993 | Tennent et al. | 473/320 |
| 6,056,648 | A | 5/2000 | Kusumoto et al. | |
| 7,918,746 | B2 * | 4/2011 | Kumamoto | 473/319 |
| 7,972,223 | B2 * | 7/2011 | Lee | 473/319 |
| 2002/0082111 | A1 * | 6/2002 | Hedrick et al. | 473/316 |
| 2005/0197204 | A1 * | 9/2005 | Cheng | 473/320 |

FOREIGN PATENT DOCUMENTS

| | | | | |
|---|---|---|---|---|
| JP | 9-234256 A | | 9/1997 | |
| JP | 10179826 A | * | 7/1998 | A63B 53/10 |
| JP | 11155986 A | * | 6/1999 | A63B 53/10 |
| JP | 2009-219681 A | | 10/2009 | |

* cited by examiner

*Primary Examiner* — Stephen L. Blau

(74) *Attorney, Agent, or Firm* — Birch, Stewart, Kolasch & Birch, LLP

(57) ABSTRACT

A shaft 6 has a plurality of layers a1 to a10. The layers include a bias layer in which an absolute angle θa of a fiber to a shaft axis line is 10 degrees or greater and 70 degrees or less, and a hoop layer in which the angle θa is equal to or greater than 80 degrees. The layers include a full length layer disposed all over in an axis direction of the shaft, and a partial layer partially disposed in the axis direction of the shaft. The partial layer includes back end reinforcing bias layers a4 and a6, and a backend reinforcing hoop layer a5. In the shaft 6, a torsional rigidity value GIt at a point separated by 300 mm from a butt end is $3.5\times10^6$ (kgf·mm$^2$/deg) or greater and $5.0\times10^6$ (kgf·mm$^2$/deg) or less.

12 Claims, 10 Drawing Sheets

GOLF CLUB SHAFT

The present application claims priority on Patent Application No. 2011-121471 filed in JAPAN on May 31, 2011, the entire contents of which are hereby incorporated by reference.

BACKGROUND OF THE INVENTION

1. Field of the Invention

The present invention relates to a golf club shaft.

2. Description of the Related Art

Flex point is known as one of specifications of a golf club shaft. High flex point, middle flex point, and low flex point are known as the flex point.

A shaft having high flex point can suppress an unstable motion of the tip part of the shaft. The shaft having high flex point has excellent operativity and small variation in a hit ball.

Japanese Patent Application Laid-Open No. 9-234256 discloses a golf club shaft which has a grip portion and a tip portion having higher torsional rigidity in a torsional rigidity distribution property line compared to a case the torsional rigidity distribution property line is drawn by a straight line. The golf club shaft has a center portion having higher flexural rigidity compared to a case the property line is drawn in a straight line. Japanese Patent Application Laid-Open No. 10-43333 (U.S. Pat. No. 6,056,648) discloses a shaft having a torsional rigidity sudden-change portion provided on a tip part side of a grip part. Japanese Patent Application Laid-Open No. 2009-219681 discloses a shaft having a steep taper part which is steeply tapered and is provided between a head side small diameter part and a grip side large diameter part.

SUMMARY OF THE INVENTION

Usually, a shaft has a taper shape. The shaft has a thin head side and a thick grip side. The thick portion tends to have large flexural rigidity. The taper-shaped shaft tends to have low flex point. A grip portion is considered to be thinned in order to produce a shaft having high flex point in the taper-shaped shaft. However, the constitution is apt to reduce the strength of the grip portion.

A constitution in which a grip portion is thickened by using a low modulus material for the grip portion is considered in order to suppress the strength reduction of the grip portion. However, in this case, a shaft weight is increased.

It is an object of the present invention to provide a lightweight golf club shaft having high operativity and excellent strength.

A shaft of the present invention has a plurality of layers. The layers include a bias layer in which an absolute angle θa of a fiber to a shaft axis line is 10 degrees or greater and 70 degrees or less, and a hoop layer in which the angle θa is equal to or greater than 80 degrees. The layers include a full length layer disposed all over in an axis direction of the shaft, and a partial layer partially disposed in the axis direction of the shaft. The partial layer includes a back end reinforcing bias layer and a back end reinforcing hoop layer. A torsional rigidity value GIt at a point separated by 300 mm from a butt end is $3.5\times10^6$ (kgf·mm$^2$/deg) or greater and $5.0\times10^6$ (kgf·mm$^2$/deg) or less.

Preferably, an axial length of the back end reinforcing bias layer is 120 mm or greater and 350 mm or less. Preferably, a back end of the back end reinforcing bias layer is located at the butt end. Preferably, an axial length of the back end reinforcing hoop layer is 120 mm or greater and 350 mm or less. Preferably, a back end of the back end reinforcing hoop layer is located at the butt end.

Preferably, an absolute angle θa of a fiber in the back end reinforcing bias layer is 20 degrees or greater and 45 degrees or less.

Preferably, the shaft is manufactured by a manufacturing method including the steps of:

preparing a first back end reinforcing bias sheet;

preparing a second back end reinforcing bias sheet;

preparing a back end reinforcing hoop sheet;

stacking the first back end reinforcing bias sheet, the second back end reinforcing bias sheet, and the back end reinforcing hoop layer with the back end reinforcing hoop layer sandwiched between the first back end reinforcing bias sheet and the second back end reinforcing bias sheet, to obtain a united sheet; and winding the united sheet.

Preferably, a resin content Rb of the back end reinforcing bias layer is 15% by mass or greater and less than 24% by mass. Preferably, a thickness Tb of the back end reinforcing bias layer is 0.05 mm or greater and less than 0.15 mm. Preferably, a resin content Rf of the back end reinforcing hoop layer is 24% by mass or greater and 40% by mass or less. Preferably, a thickness Tf of the back end reinforcing hoop layer is 0.02 mm or greater and less than 0.10 mm.

A lightweight golf club shaft suppressing flexural rigidity of a grip portion and having excellent strength can be obtained.

DESCRIPTION OF THE PREFERRED EMBODIMENTS

Hereinafter, the present invention will be described in detail based on the preferred embodiments with appropriate references to the accompanying drawings.

The term "layer" and the term "sheet" are used in the present application. The "layer" is termed after being wound. On the other hand, the "sheet" is termed before being wound. The "layer" is formed by winding the "sheet". That is, the wound "sheet" forms the "layer".

In the present application, an "inside" means an inside in a radial direction of a shaft. In the present application, an "outside" means an outside in the radial direction of the shaft.

In the present application, an "axis direction" means an axis direction of the shaft.

In the present application, an angle Af and an absolute angle θa are used for the angle of a fiber to the axis direction.

The angle Af is a plus and minus angles. The absolute angle θa is the absolute value of the angle Af. In other words, the absolute angle θa is the absolute value of an angle between the axis direction and the direction of the fiber. For example, "the absolute angle θa is equal to or less than 10 degrees" means that "the angle Af is −10 degrees or greater and +10 degrees or less".

Figure 1:
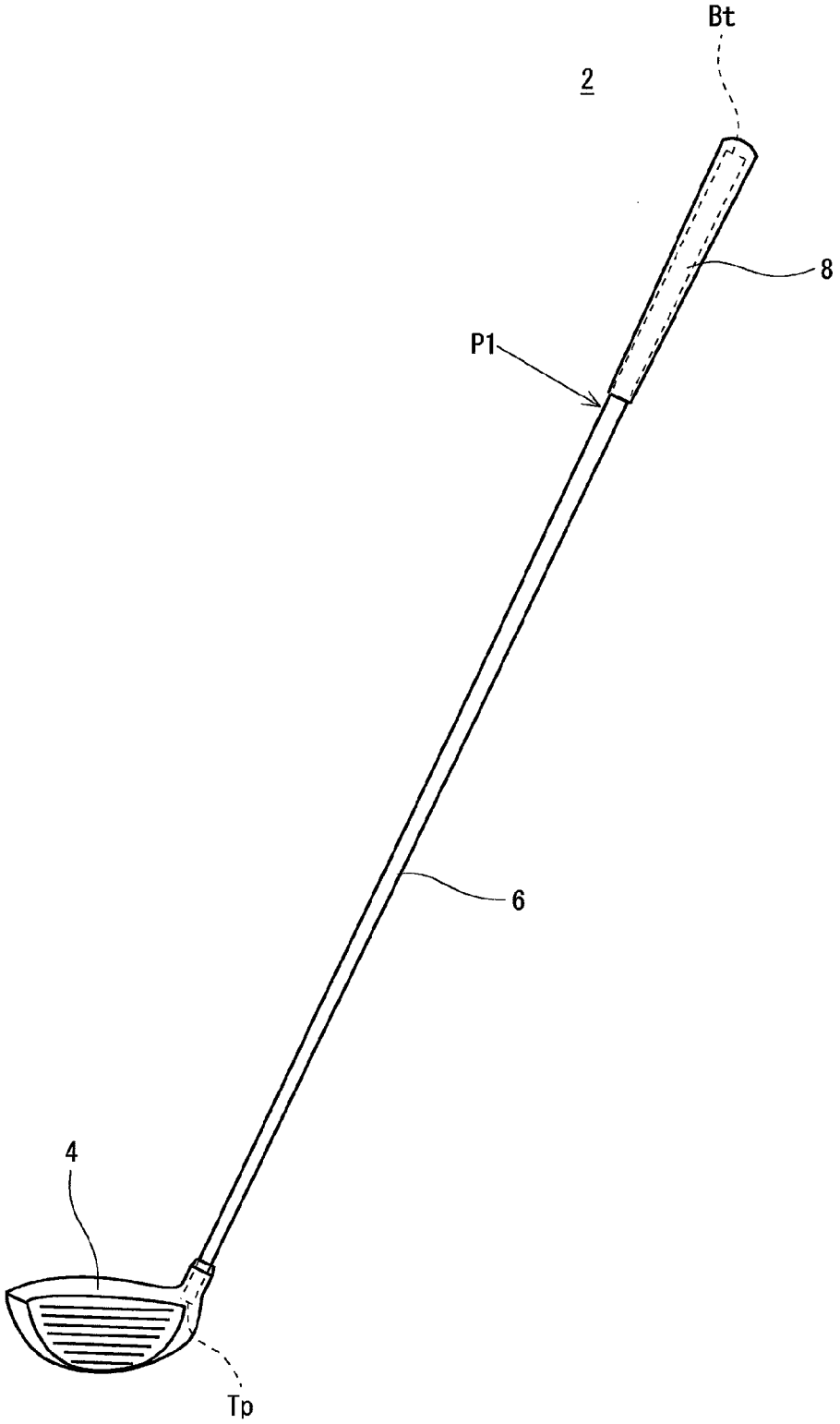
FIG. 1 shows a golf club provided with a shaft according to an embodiment of the present invention.

FIG. 1 shows a golf club 2 provided with a golf club shaft 6 according to an embodiment of the present invention. The golf club 2 is provided with a head 4, a shaft 6, and a grip 8. The head 4 is provided at the tip part of the shaft 6. The grip 8 is provided at the back end part of the shaft 6. The head 4 and the grip 8 are not restricted. Examples of the head 4 include a wood type golf club head, an iron type golf club head, and a putter head.

The shaft 6 includes a laminate of fiber reinforced resin layers. The shaft 6 is a tubular body. The shaft 6 has a hollow structure. As shown in FIG. 1, the shaft 6 has a tip end Tp and a butt end Bt. The tip end Tp is located in the head 4. The butt end Bt is located in the grip 8.

The shaft 6 is a so-called carbon shaft. The shaft 6 is preferably produced by curing a prepreg sheet. In the prepreg sheet, a fiber is oriented substantially in one direction. Thus, the prepreg in which the fiber is oriented substantially in one direction is also referred to as a UD prepreg. The term "UD" stands for uni-direction. Prepregs other than the UD prepreg may be used. For example, fibers contained in the prepreg sheet may be woven.

The prepreg sheet has a fiber and a resin. The resin is also referred to as a matrix resin. The fiber is typically a carbon fiber. The matrix resin is typically a thermosetting resin.

The shaft 6 is manufactured by a so-called sheet winding method. In the prepreg, the matrix resin is in a semicured state. The shaft 6 is obtained by winding and curing the prepreg sheet. The curing means the curing of the semicured matrix resin. The curing is attained by heating. The manufacturing process of the shaft 6 includes a heating process. The heating process cures the matrix resin of the prepreg sheet.

Figure 2:
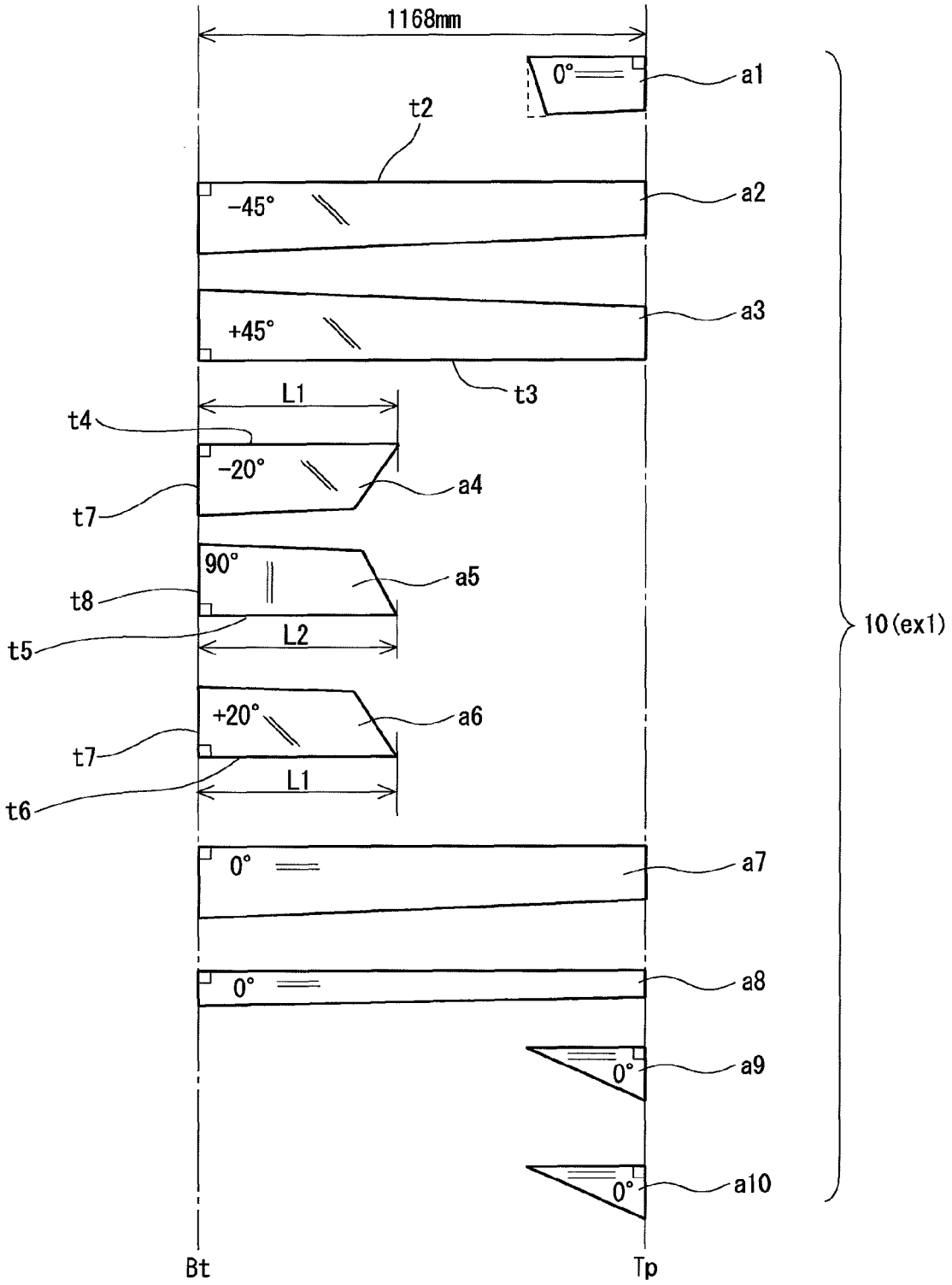
FIG. 2 is a developed view of a shaft according to a first embodiment, and is also a developed view of example 1.

FIG. 2 is a developed view (sheet constitution view) of the prepreg sheets constituting the shaft 6. The shaft 6 includes a plurality of sheets. In the embodiment of FIG. 2, the shaft 6 includes ten sheets a1 to a10. In the present application, the developed view shown in FIG. 2 or the like shows the sheets constituting the shaft in order from the radial inside of the shaft. The sheets are wound in order from the sheet located above in the developed view. In the developed view of the present application, the horizontal direction of the figure coincides with the axis direction of the shaft. In the developed view of the present application, the right side of the figure is the tip end Tp side of the shaft. In the developed view of the present application, the left side of the figure is the butt end Bt side of the shaft.

The developed view of the present application shows not only the winding order of each of the sheets but also the disposal of each of the sheets in the axis direction of the shaft. For example, in FIG. 2, one end of the sheet a1 is located at the tip end Tp.

The shaft 6 has a straight layer, a bias layer, and a hoop layer. The orientation angle of the fiber is described in the developed view of the present application. A sheet described as "0 degree" constitutes the straight layer. The sheet for the straight layer is also referred to as a straight sheet in the present application.

The straight layer is a layer in which the orientation direction of the fiber is substantially 0 degree to the longitudinal direction (axis direction of the shaft) of the shaft. The orientation of the fiber may not be completely set to 0 degree to the axis direction of the shaft by error or the like in winding. Usually, in the straight layer, the absolute angle θa is less than 10 degrees.

In the embodiment of FIG. 2, the straight sheets are the sheet a1, the sheet a7, the sheet a8, the sheet a9, and the sheet a10. The straight layer is highly correlated with the flexural rigidity and flexural strength of the shaft.

On the other hand, the bias layer is highly correlated with the torsional rigidity and torsional strength of the shaft. Preferably, the bias layer includes two sheets in which orientation angles of fibers are inclined in opposite directions to each other. In respect of the torsional rigidity, the absolute angle θa of the bias layer is preferably equal to or greater than 10 degrees, more preferably equal to or greater than 15 degrees, and still more preferably equal to or greater than 20 degrees. In respect of the flexural strength, the absolute angle θa of the bias layer is preferably equal to or less than 70 degrees, and more preferably equal to or less than 60 degrees.

In the shaft 6, the sheets constituting the bias layer are the sheet a2, the sheet a3, the sheet a4, and the sheet a6. In FIG. 2, the angle Af is described in each sheet. The plus (+) and minus (−) in the angle Af show that the fibers of bias sheets are inclined in opposite directions to each other. In the present application, the sheet for the bias layer is also merely referred to as the bias sheet.

In the embodiment of FIG. 2, the angle of the sheet a2 is −45 degrees and the angle of the sheet a3 is +45 degrees. However, conversely, it should be appreciated that the angle of the sheet a2 may be +45 degrees and the angle of the sheet a3 may be −45 degrees.

In the shaft 6, the sheet constituting the hoop layer is the sheet a5. Preferably, the absolute angle θa in the hoop layer is substantially 90 degrees to a shaft axis line. However, the orientation direction of the fiber to the axis direction of the shaft may not be completely set to 90 degrees by error or the like in winding. Usually, in the hoop layer, the absolute angle θa is 80 degrees or greater and 90 degrees or less. In the present application, the prepreg sheet for the hoop layer is also referred to as a hoop sheet.

The hoop layer contributes to enhancement of the crushing rigidity and crushing strength of the shaft. The crushing rigidity is rigidity to a force crushing the shaft toward the inside of the radial direction thereof. The crushing strength is strength to a force crushing the shaft toward the inside of the radial direction thereof. The crushing strength can be also involved with the flexural strength. Crushing deformation can be generated with flexural deformation. In a particularly thin lightweight shaft, this interlocking property is large. The enhancement of the crushing strength also can cause the enhancement of the flexural strength.

Although not shown in the drawings, the prepreg sheet before being used is sandwiched between cover sheets. The cover sheets are usually a mold release paper and a resin film. That is, the prepreg sheet before being used is sandwiched between the mold release paper and the resin film. The mold release paper is applied to one surface of the prepreg sheet, and the resin film is applied to the other surface of the prepreg sheet. Hereinafter, the surface to which the mold release paper is applied is also referred to as "a surface of a mold release paper side", and the surface to which the resin film is applied is also referred to as "a surface of a film side".

In the developed view of the present application, the surface of the film side is the front side. That is, in the developed view of the present application, the front side of the figure is the surface of the film side, and the back side of the figure is the surface of the mold release paper side. For example, in FIG. 2, the direction of the fiber of the sheet a2 is the same as that of the sheet a3. However, in the case of the stacking to be described later, the sheet a3 is reversed. As a result, the directions of the fibers of the sheets a2 and a3 are opposite to each other. Therefore, in the state after being wound, the directions of the fibers of the sheets a2 and a3 are opposite to each other. In light of this point, in FIG. 2, the direction of the fiber of the sheet a2 is described as "−45 degrees", and the direction of the fiber of the sheet a3 is described as "+45 degrees".

In order to wind the prepreg sheet, the resin film is previously peeled. The surface of the film side is exposed by peeling the resin film. The exposed surface has tacking property (tackiness). The tacking property is caused by the matrix resin. That is, since the matrix resin is in a semicured state, the tackiness is developed. Next, the edge part of the exposed surface of the film side (also referred to as a winding start edge part) is applied to a wound object. The winding start edge part can be smoothly applied by the tackiness of the matrix resin. The wound object is a mandrel or a wound article obtained by winding the other prepreg sheet around the mandrel. Next, the mold release paper is peeled. Next, the wound object is rotated to wind the prepreg sheet around the wound object. Thus, the resin film is previously peeled, then, the winding start edge part is applied to the wound object, and then, the mold release paper is then peeled. Thus, the resin film is previously peeled, after the winding start edge part is applied to the wound object, and then, the mold release paper is peeled. The procedure suppresses wrinkles and winding fault of the sheet. This is because the sheet to which the mold release paper is applied is supported by the mold release paper, and hardly causes wrinkles. The mold release paper has bending rigidity higher than that of the resin film.

A united sheet is used in the embodiment of FIG. 2. The united sheet is formed by stacking two or more sheets.

The two united sheets are formed in the embodiment of FIG. 2. A first united sheet a23 (not shown) is formed by stacking the sheet a2 and the sheet a3.

Although not shown in the drawings, an end t2 (see FIG. 2) of the sheet a2 and an end t3 (see FIG. 2) of the sheet a3 are deviated for a half circle in the united sheet a23. That is, in the section of the shaft after being wound, the circumferential position of the end t2 and the circumferential position of the end t3 are different by 180 degrees (±15 degrees) from each other.

Figure 3:
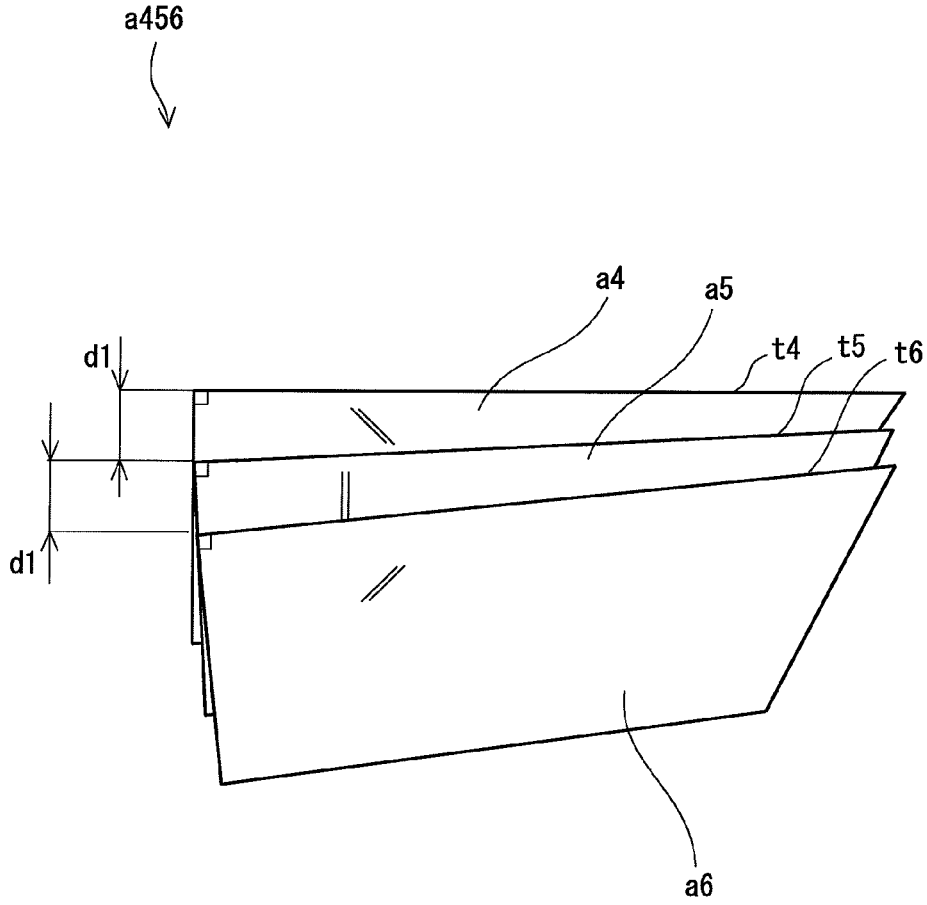
FIG. 3 shows a united sheet according to the shaft of FIG. 1.

A second united sheet a456 is formed by stacking the sheet a4, the sheet a5, and the sheet a6. FIG. 3 shows the united sheet a456. As shown in FIG. 3, in the united sheet a456, the sheet a5 is sandwiched between the sheet a4 and the sheet a6.

In the united sheet a456, an end t4 of sheet a4 and an end t5 of the sheet a5 are deviated from each other for a (¼) circle. After winding, the circumferential position of the end t4 and the circumferential position of the end t5 are different by 90 degrees (±15 degrees) from each other. The difference of 90 degrees is caused by a deviation distance d1 (see FIG. 3). Furthermore, in the united sheet a456, the end t5 of the sheet a5 and an end t6 of sheet a6 are deviated from each other for a (¼) circle. After winding, the circumferential position of the end t5 and the circumferential position of the end t6 are different by 90 degrees (±15 degrees) from each other. The difference of 90 degrees is caused by the deviation distance d1 (see FIG. 3).

After winding, the circumferential position of the end t4 and the circumferential position of the end t6 are different by 180 degrees (±15 degrees) from each other.

The uniformity of the shaft in the circumferential direction is improved by deviating the circumferential positions of the ends t4, t5, and t6. The circumferential positions of the ends t4, t5, and t6 may coincide with each other.

In the present application, the sheet and the layer are classified by the orientation angle of the fiber. Furthermore, in the present application, the sheet and the layer are classified by the length of the axis direction of the shaft.

In the present application, a layer disposed all over in the axis direction of the shaft is referred to as a full length layer. In the present application, a sheet disposed all over in the axis direction of the shaft is referred to as a full length sheet. The wound full length sheet forms the full length layer.

On the other hand, in the present application, a layer partially disposed in the axis direction of the shaft is referred to as a partial layer. In the present application, a sheet partially disposed in the axis direction of the shaft is referred to as a partial sheet. The wound partial sheet forms the partial layer.

In the present application, the full length layer which is the bias layer is referred to as a full length bias layer. In the present application, the full length layer which is the straight layer is referred to as a full length straight layer. In the present application, the full length layer which is the hoop layer is referred to as a full length hoop layer.

In the present application, the partial layer which is the bias layer is referred to as a partial bias layer. In the present application, the partial layer which is the straight layer is referred to as a partial straight layer. In the present application, the partial layer which is the hoop layer is referred to as a partial hoop layer.

In the present application, the term "back end reinforcing bias layer" is used. The back end reinforcing bias layer is the partial bias layer. Preferably, the back end reinforcing bias layer is the partial bias layer wholly located on the butt side of the center position in the axis direction of the shaft. The back end of the back end reinforcing bias layer may not be located at the butt end Bt of the shaft, and may be located at the butt end Bt of the shaft. In respect of reinforcing the back end of the shaft, the back end of the back end reinforcing bias layer is preferably located at the butt end Bt of the shaft. In respect of reinforcing the back end portion of the shaft, the disposal range of the back end reinforcing bias layer preferably includes a position P1 (see FIG. 1) separated by 300 mm from the butt end Bt of the shaft.

In the present application, the term "back end reinforcing hoop layer" is used. The back end reinforcing hoop layer is the partial hoop layer. Preferably, the back end reinforcing hoop layer is the partial hoop layer wholly located on the butt side of the center position in the axis direction of the shaft. The back end of the back end reinforcing hoop layer may not be located at the butt end Bt of the shaft, and may be located at the butt end Bt of the shaft. In respect of reinforcing the back end portion of the shaft, the disposal range of the back end reinforcing hoop layer preferably includes a position P1 separated by 300 mm from the butt end Bt of the shaft.

The shaft 6 is produced by the sheet winding method using the sheets shown in FIG. 2.

Hereinafter, a manufacturing process of the shaft 6 will be schematically described.

[Outline of Manufacturing Process of Shaft]

(1) Cutting Process

The prepreg sheet is cut into a desired shape in the cutting process. Each of the sheets shown in FIG. 2 is cut out by the process.

The cutting may be performed by a cutting machine, or may be manually performed. In the manual case, for example, a cutter knife is used.

(2) Stacking Process

A plurality of sheets is stacked in the stacking process, to produce the above-mentioned united sheets a23 and a456.

In the stacking process, heating or a press may be used. More preferably, the heating and the press are used in combination. In a winding process to be described later, the deviation of the sheet may be produced during the winding operation of the united sheet. The deviation reduces winding accuracy. The heating and the press improve an adhesive force between the sheets. The heating and the press suppress the deviation between the sheets in the winding process.

In respect of enhancing the adhesive force between the sheets, a heating temperature in the stacking process is preferably equal to or greater than 30° C., and more preferably equal to or greater than 35° C. When the heating temperature is too high, the curing of the matrix resin may be progressed, to reduce the tackiness of the sheet. The reduction of the tackiness reduces adhesion between the united sheet and the wound object. The reduction of the adhesion may allow the generation of wrinkles, to generate the deviation of a winding position. In this respect, the heating temperature in the stacking process is preferably equal to or less than 60° C., more preferably equal to or less than 50° C., and still more preferably equal to or less than 40° C.

In respect of enhancing the adhesive force between the sheets, a heating time in the stacking process is preferably equal to or greater than 20 seconds, and more preferably equal to or greater than 30 seconds. In respect of the tackiness of the sheet, the heating time in the stacking process is preferably equal to or less than 300 seconds.

In respect of enhancing the adhesive force between the sheets, a press pressure in the stacking process is preferably equal to or greater than 300 g/cm$^2$, and more preferably equal to or greater than 350 g/cm$^2$. When the press pressure is excessive, the prepreg may be crushed. In this case, the thickness of the prepreg is made thinner than a designed value. In respect of thickness accuracy of the prepreg, the press pressure in the stacking process is preferably equal to or less than 600 g/cm$^2$, and more preferably equal to or less than 500 g/cm$^2$.

In respect of enhancing the adhesive force between the sheets, a press time in the stacking process is preferably equal to or greater than 20 seconds, and more preferably equal to or greater than 30 seconds. In respect of the thickness accuracy of the prepreg, the press time in the stacking process is preferably equal to or less than 300 seconds.

(3) Winding Process

A mandrel is prepared in the winding process. A typical mandrel is made of a metal. A mold release agent is applied to the mandrel. Furthermore, a resin having tackiness is applied to the mandrel. The resin is also referred to as a tacking resin. The cut sheet is wound around the mandrel. The tacking resin facilitates the application of the end part of the sheet to the mandrel.

The stacked sheets are wound in a state of the united sheet.

A winding body is obtained by the winding process. The winding body is obtained by wrapping the prepreg sheet around the outside of the mandrel. For example, the winding is performed by rolling the wound object on a plane. The winding may be performed by a manual operation or a machine. The machine is referred to as a rolling machine.

(4) Tape Wrapping Process

A tape is wrapped around the outer peripheral surface of the winding body in the tape wrapping process. The tape is also referred to as a wrapping tape. The wrapping tape is wrapped while tension is applied to the wrapping tape. A pressure is applied to the winding body by the wrapping tape. The pressure reduces voids.

(5) Curing Process

In the curing process, the winding body after performing the tape wrapping is heated. The heating cures the matrix resin. In the curing process, the matrix resin fluidizes temporarily. The fluidization of the matrix resin can discharge air between the sheets or in the sheet. The pressure (fastening force) of the wrapping tape accelerates the discharge of the air. The curing provides a cured laminate.

(6) Process of Extracting Mandrel and Process of Removing Wrapping Tape

The process of extracting the mandrel and the process of removing the wrapping tape are performed after the curing process. The order of the both processes is not restricted. However, the process of removing the wrapping tape is preferably performed after the process of extracting the mandrel in respect of improving the efficiency of the process of removing the wrapping tape.

(7) Process of Cutting Both Ends

The both end parts of the cured laminate are cut in the process. The cutting flattens the end face of the tip end Tp and the end face of the butt end Bt.

(8) Polishing Process

The surface of the cured laminate is polished in the process. Spiral unevenness left behind as the trace of the wrapping tape exists on the surface of the cured laminate. The polishing extinguishes the unevenness as the trace of the wrapping tape to flatten the surface of the cured laminate.

(9) Coating Process

The cured laminate after the polishing process is subjected to coating.

The shaft 6 is obtained in the processes. Hereinafter, the shaft 6 will be described in detail. In the present application, the same reference numeral is used in the layer and the sheet. For example, a layer formed by a sheet a1 is defined as a layer a1.

The shaft 6 has back end reinforcing bias layers a4 and a6, and a back end reinforcing hoop layer a5. A back end reinforcing straight layer is absent.

The following items (a) to (d) can be attained by the combination of the back end reinforcing bias layers a4 and a6 and the back end reinforcing hoop layer a5:

(a) The weight increase of the shaft on the butt side is suppressed;

(b) The flexural rigidity of the shaft on the butt side is not excessively increased;

(c) The strength of the shaft on the butt side is improved; and (d) The torsional rigidity of the shaft on the butt side is improved.

Therefore, the shaft 6 is lightweight, and has excellent strength. A small flex point ratio of the shaft 6 can be caused by the item (b). The shaft having a small flex point ratio has high flex point. The shaft 6 has excellent operativity.

In the shaft 6, a torsional rigidity value GIt at a point P1 separated by 300 mm from the butt end Bt is $3.5\times10^6$ (kgf·mm$^2$/deg) or greater and $5.0\times10^6$ (kgf·mm$^2$/deg) or less. The point P1 is a position near the grip 8. When the torsional rigidity value GIt is excessively small, the operativity is reduced. In this respect, the torsional rigidity value GIt is preferably equal to or greater than $3.7\times10^6$ (kgf·mm$^2$/deg), and more preferably equal to or greater than $3.9\times10^6$ (kgf·mm$^2$/deg).

When the torsional rigidity value GIt is excessively increased, a prepreg (high elastic prepreg) having a fiber with a high elastic modulus is used. The tensile strength of the fiber having a high elastic modulus is comparatively low. Therefore, the high elastic prepreg may reduce the strength of the shaft. In respect of the shaft strength, the torsional rigidity value GIt is preferably equal to or less than $4.9\times10^6$ (kgf·mm$^2$/deg), and more preferably equal to or less than $4.8\times10^6$ (kgf·mm$^2$/deg)

In respect of enhancing the torsional rigidity value GIt, and in respect of suppressing the flexural rigidity of the back end part, the absolute angle θa of the fiber in the back end reinforcing bias layers a4 and a6 is preferably equal to or greater than 10 degrees, more preferably equal to or greater than 15 degrees, still more preferably equal to or greater than 20 degrees, and yet still more preferably equal to or greater than 30 degrees. In respect of preventing the excessive reduction of the flexural rigidity of the butt side portion of the shaft, the absolute angle θa of the fiber in the back end reinforcing bias layers a4 and a6 is preferably equal to or less than 60 degrees, and more preferably equal to or less than 45 degrees.

An axial length of the back end reinforcing bias layer is represented by reference numeral L1 in FIG. 2. A head side portion of the positions of both hands holding the grip is greatly deformed during a swing. Therefore, the back end reinforcing bias layer is preferably disposed on the portion. In this respect, the length L1 is preferably equal to or greater than 120 mm, more preferably equal to or greater than 130 mm, and still more preferably equal to or greater than 140 mm. It is hard to swing a too heavy shaft. In respect of suppressing the shaft weight, the length L1 is preferably equal to or less than 350 mm, more preferably equal to or less than 340 mm, and still more preferably equal to or less than 330 mm.

An axial length of the back end reinforcing hoop layer is represented by reference numeral L2 in FIG. 2. A head side portion of the positions of both hands holding the grip is greatly deformed during a swing. Therefore, the back end reinforcing hoop layer is preferably disposed on the portion. In this respect, the length L2 is preferably equal to or greater than 120 mm, more preferably equal to or greater than 130 mm, and still more preferably equal to or greater than 140 mm. It is hard to swing a too heavy shaft. In respect of suppressing the shaft weight, the length L2 is preferably equal to or less than 350 mm, more preferably equal to or less than 340 mm, and still more preferably equal to or less than 330 mm.

In the embodiment of FIG. 2, back ends t7 of the back end reinforcing bias layers a4 and a6 are located at the butt end Bt. Furthermore, in the embodiment of FIG. 2, a back end t8 of the back end reinforcing hoop layer a5 is located at the butt end Bt. Therefore, the back end part of the shaft is effectively reinforced.

As described above, the shaft 6 is manufactured by a manufacturing method including the steps of: preparing the first back end reinforcing bias sheet a4; preparing the second back end reinforcing bias sheet a6; preparing the back end reinforcing hoop sheet a5; and stacking the first back end reinforcing bias sheet a4, the second back end reinforcing bias sheet a6, and the back end reinforcing hoop layer a5 with the back end reinforcing hoop layer a5 sandwiched between the first back end reinforcing bias sheet a4 and the second back end reinforcing bias sheet a6, to obtain the united sheet a456; and winding the united sheet a456. The use of the united sheet a456 suppresses winding faults (generation of wrinkles and deviation of the fiber, or the like) in the winding process, and thereby winding accuracy is improved. Therefore, the back end reinforcing bias sheet and the back end reinforcing hoop sheet can be wound with high dimensional accuracy. The workability of the winding process is improved.

The number of windings of the back end reinforcing hoop sheet a5 is 2; the number of windings of the first back end reinforcing bias sheet a4 is also 2; and the number of windings of the second back end reinforcing bias sheet a6 is also 2. The number of windings of the back end reinforcing hoop sheet a5, the number of windings of the first back end reinforcing bias sheet a4, and the number of windings of the second back end reinforcing bias sheet a6 coincide with each other.

In the united sheet a456, the resin content of the back end reinforcing hoop sheet a5 is preferably greater than those of the back end reinforcing bias sheets a4 and a6. The sheet a5 having a higher resin content has an excellent tacky force. Therefore, in the united sheet a456, the sheet a4 and the sheet a6 are strongly stacked with the sheet a5 sandwiched therebetween. Therefore, in the winding of the united sheet a456, the peeling and deviation of the sheet are effectively suppressed. Therefore, the backend reinforcing bias sheet and the back end reinforcing hoop sheet can be wound with high dimensional accuracy.

When the resin content Rb of the backend reinforcing bias layer is excessively small, the tackiness of the sheet is apt to be reduced, and the winding accuracy is apt to be reduced. In respect of the winding accuracy, the resin content Rb is preferably equal to or greater than 15% by mass, and more preferably equal to or greater than 17% by mass. When a shaft outer diameter is increased in respect of a cross sectional secondary moment, the flexural rigidity is increased. When the flexural rigidity is increased, the shaft is hard to have high flex point. The reduction of the resin content Rb suppresses the shaft outer diameter, and suppresses the flexural rigidity. In respects of suppressing the flexural rigidity and of suppressing the shaft weight, the resin content Rb is preferably less than 24% by mass, and more preferably equal to or less than 22% by mass.

As described above, in order to obtain the shaft having high flex point, the shaft outer diameter on the butt side is preferably suppressed. In this respect, the thickness Tb of the back end reinforcing bias layer is preferably less than 0.15 mm, and more preferably equal to or less than 0.13 mm. In respect of the torsional rigidity, the thickness Tb is preferably equal to or greater than 0.05 mm, and more preferably equal to or greater than 0.06 mm.

In respect of suppressing the winding fault, the resin content Rf of the back end reinforcing hoop layer is preferably equal to or greater than 24% by mass, and more preferably equal to or greater than 30% by mass. In respect of suppressing the shaft weight, the resin content Rf is preferably equal to or less than 40% by mass, and more preferably equal to or less than 35% by mass.

In respect of suppressing the shaft outer diameter, the thickness Tf of the back end reinforcing hoop layer is preferably less than 0.10 mm, and more preferably equal to or less than 0.07 mm. In respect of the shaft strength, the thickness Tf is preferably equal to or greater than 0.02 mm, and more preferably equal to or greater than 0.03 mm.

In respect of suppressing the shaft outer diameter, the number of windings (the number of plies) of the back end reinforcing bias layer is preferably equal to or less than 6, and more preferably equal to or less than 4. In respect of the torsional rigidity, the number of windings of the back end reinforcing bias layer is preferably equal to or greater than 2. In the embodiment of FIG. 2, the number of windings of the sheet a4 is 2, and the number of windings of the sheet a6 is 2. Thereby, the number of windings of the back end reinforcing bias layer is 4.

In respect of suppressing the shaft outer diameter, the number of windings (the number of plies) of the back end reinforcing hoop layer is preferably equal to or less than 3, and more preferably equal to or less than 2. In respect of the shaft strength, the number of windings of the back end reinforcing hoop layer is preferably equal to or greater than 1. In the embodiment of FIG. 2, the number of windings of the sheet a5 is 2, and thereby the number of windings of the back end reinforcing hoop layer is 2.

In the present application, a flex point ratio of the shaft (%) is defined by the following formula.

$$C1=[F2/(F1+F2)]\times 100$$

F1 is a forward flex (mm), and F2 is a backward flex (mm). As described above, the shaft having high flex point advantageously has high operativity. In this respect, the flex point ratio C1 is preferably equal to or less than 50%, more preferably less than 50%, still more preferably equal to or less than 49%, and yet still more preferably equal to or less than 48%. When the backward flex F2 is excessively small (hard), the impact strength of the shaft is reduced. In this respect, the flex point ratio C1 is preferably equal to or greater than 20%, more preferably equal to or greater than 30%, and still more preferably equal to or greater than 35%.

The constitution can suppress the weight of the shaft. In this respect, the shaft weight is preferably equal to or less than 65 g, more preferably equal to or less than 60 g, and still more preferably equal to or less than 55 g. In respect of the shaft strength, a shaft mass is preferably equal to or greater than 35 g, and more preferably equal to or greater than 40 g.

When the shaft is long, the effect of the present invention is more remarkable. In this respect, the shaft length is preferably equal to or greater than 40 inch, and more preferably equal to or greater than 45 inch. In respect of the conformity of the shaft to the golf rule, the shaft length is preferably equal to or less than 48 inch.

In addition to an epoxy resin, a thermosetting resin other than the epoxy resin and a thermoplastic resin or the like may be also used as the matrix resin of the prepreg sheet. In respect of the shaft strength, the matrix resin is preferably the epoxy resin.

The following Table 1 shows examples of the prepregs capable of being used for the shaft of the present invention.

EXAMPLES

Hereinafter, the effects of the present invention will be clarified by examples. However, the present invention should not be interpreted in a limited way based on the description of examples.

Example 1

A shaft having the same laminate constitution as that of the shaft 6 was produced. That is, a shaft having a sheet constitution shown in FIG. 2 was produced. A manufacturing method was the same as that of the shaft 6. A united sheet a456 shown in FIG. 3 was used.

In example 1, the product name and the number of windings of each sheet were as follows. The specifications of these products are shown in Table 1 described above.

Sheet a1: TR350C-150S (two plies)
Sheet a2: MR350C-100S (two plies)
Sheet a3: MR350C-100S (two plies)
Sheet a4: 2256S-12 (two plies)
Sheet a5: 805S-3 (two plies)
Sheet a6: 2256S-12 (two plies)
Sheet a7: MR350C-100S (two plies)
Sheet a8: MR350C-100S (one ply)
Sheet a9: TR350C-100S
Sheet a10: TR350C-100S A commercially available driver head (New XXIO (2011 model) manufactured by SRI Sports Limited.: loft 10.5 degrees) and grip were attached to the obtained shaft, to obtain a golf club according to example 1.

Example 2

Figure 4:
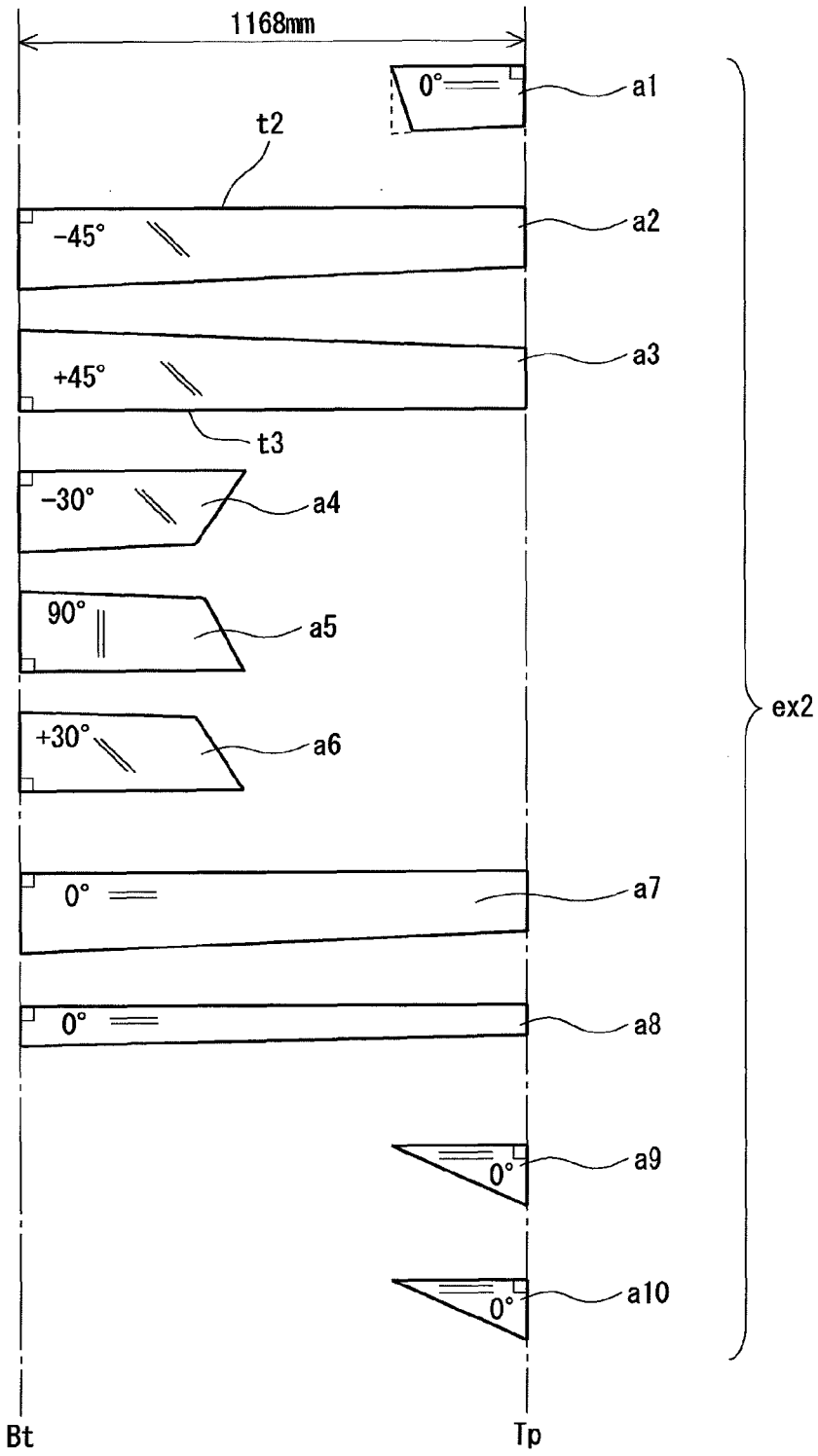
FIG. 4 is a developed view of example 2.

FIG. 4 shows a laminate constitution of a shaft according to example 2. In example 2, the product name and the number of windings of each sheet were as follows.

Sheet a1: TR350C-150S (two plies)
Sheet a2: MR350C-100S (two plies)
Sheet a3: MR350C-100S (two plies)
Sheet a4: 2256S-12 (two plies)

TABLE 1

Examples of prepregs capable of being used

| | | | | | Physical property value of carbon fiber | | |
|---|---|---|---|---|---|---|---|
| Manufacturer | Part number of prepreg | Thickness of sheet (mm) | Fiber content (% by mass) | Resin content (% by mass) | Part number of carbon fiber | Tensile elastic modulus ($t/mm^2$) | Tensile strength ($kgf/mm^2$) |
| Toray Industries, Inc. | 3255S-10 | 0.082 | 76 | 24 | T700S | 23.5 | 500 |
| Toray Industries, Inc. | 3255S-12 | 0.103 | 76 | 24 | T700S | 23.5 | 500 |
| Toray Industries, Inc. | 3255S-15 | 0.123 | 76 | 24 | T700S | 23.5 | 500 |
| Toray Industries, Inc. | 805S-3 | 0.034 | 60 | 40 | M30S | 30 | 560 |
| Toray Industries, Inc. | 2255S-10 | 0.082 | 76 | 24 | T800S | 30 | 600 |
| Toray Industries, Inc. | 2255S-12 | 0.102 | 76 | 24 | T800S | 30 | 600 |
| Toray Industries, Inc. | 2255S-15 | 0.123 | 76 | 24 | T800S | 30 | 600 |
| Toray Industries, Inc. | 2256S-10 | 0.077 | 80 | 20 | T800S | 30 | 600 |
| Toray Industries, Inc. | 2256S-12 | 0.096 | 80 | 20 | T800S | 30 | 600 |
| Mitsubishi Rayon Co., Ltd. | TR350C-100S | 0.083 | 75 | 25 | TR50S | 24 | 500 |
| Mitsubishi Rayon Co., Ltd. | TR350C-125S | 0.104 | 75 | 25 | TR50S | 24 | 500 |
| Mitsubishi Rayon Co., Ltd. | TR350C-150S | 0.124 | 75 | 25 | TR50S | 24 | 500 |
| Mitsubishi Rayon Co., Ltd. | MR350C-075S | 0.063 | 75 | 25 | MR40 | 30 | 450 |
| Mitsubishi Rayon Co., Ltd. | MR350C-100S | 0.085 | 75 | 25 | MR40 | 30 | 450 |
| Mitsubishi Rayon Co., Ltd. | MR350C-125S | 0.105 | 75 | 25 | MR40 | 30 | 450 |
| Mitsubishi Rayon Co., Ltd. | MR350E-100S | 0.093 | 70 | 30 | MR40 | 30 | 450 |
| Mitsubishi Rayon Co., Ltd. | HRX350C-075S | 0.057 | 75 | 25 | HR40 | 40 | 450 |
| Mitsubishi Rayon Co., Ltd. | HRX350C-110S | 0.082 | 75 | 25 | HR40 | 40 | 450 |

A tensile strength and a tensile elastic modulus are values measured in accordance with JIS R7601:1986 "Testing Method for Carbon Fibers Sheet a5: 805S-3 (two plies)
Sheet a6: 2256S-12 (two plies)
Sheet a7: MR350C-100S (two plies)
Sheet a8: MR350C-100S (one ply)
Sheet a9: TR350C-100S
Sheet a10: TR350C-100S A shaft and a golf club according to example 2 were obtained in the same manner as in example 1 except for above.

Example 3

Figure 5:
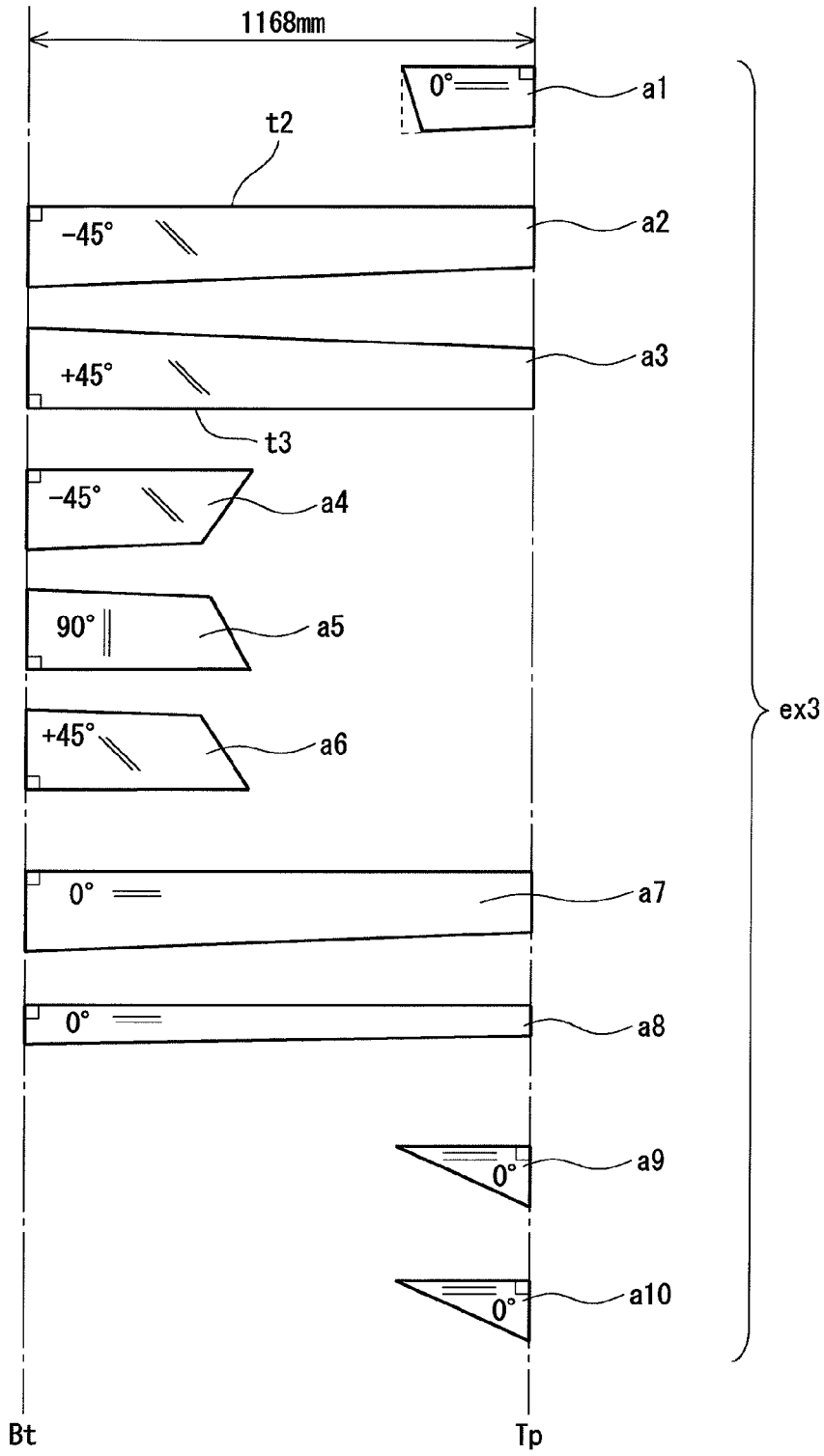
FIG. 5 is a developed view of example 3.

FIG. 5 shows a laminate constitution of a shaft according to example 3. In example 3, the product name and the number of windings of each sheet were as follows.

Sheet a1: TR350C-150S (two plies)
Sheet a2: MR350C-100S (two plies)
Sheet a3: MR350C-100S (two plies)
Sheet a4: 2256S-12 (two plies)
Sheet a5: 805S-3 (two plies)
Sheet a6: 2256S-12 (two plies)
Sheet a7: MR350C-100S (two plies)
Sheet a8: MR350C-100S (one ply)
Sheet a9: TR350C-100S
Sheet a10: TR350C-100S A shaft and a golf club according to example 3 were obtained in the same manner as in example 1 except for above.

Comparative Example 1

Figure 6:
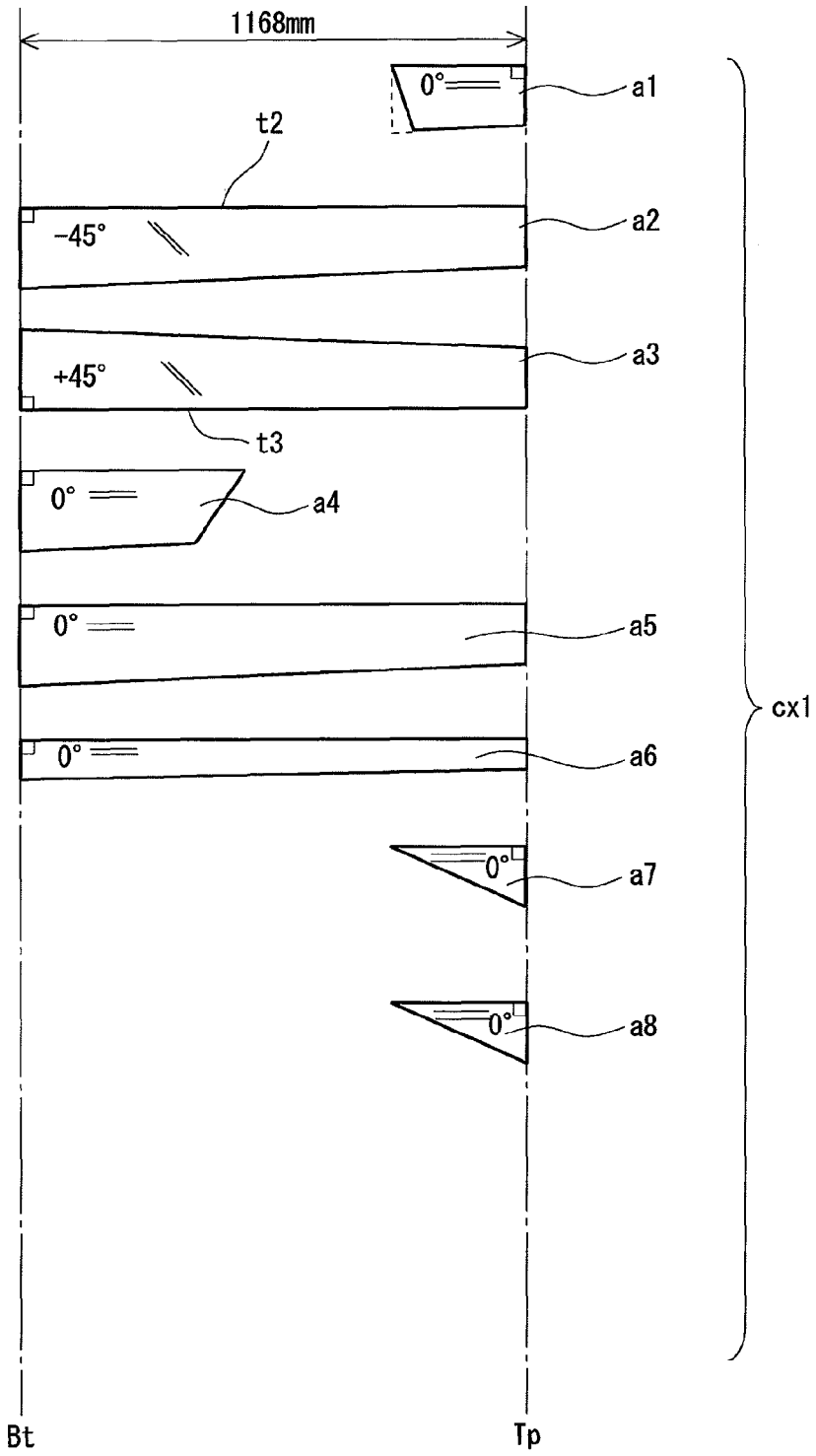
FIG. 6 is a developed view of comparative example 1.

FIG. 6 shows a laminate constitution of a shaft according to comparative example 1. In comparative example 1, the product name and the number of windings of each sheet were as follows.

Sheet a1: TR350C-150S (two plies)
Sheet a2: MR350C-100S (two plies)
Sheet a3: MR350C-100S (two plies)
Sheet a4: MR350C-100S (two plies)
Sheet a5: MR350C-100S (two plies)
Sheet a6: MR350C-100S (one ply)
Sheet a7: TR350C-100S
Sheet a8: TR350C-100S In comparative example 1, a back end reinforcing bias layer and a back end reinforcing hoop layer were not used. In comparative example 1, a back end reinforcing straight layer was used. The back end reinforcing straight layer was a sheet a4. A shaft and a golf club according to comparative example 1 were obtained in the same manner as in example 1 except for above.

Comparative Example 2

Figure 7:
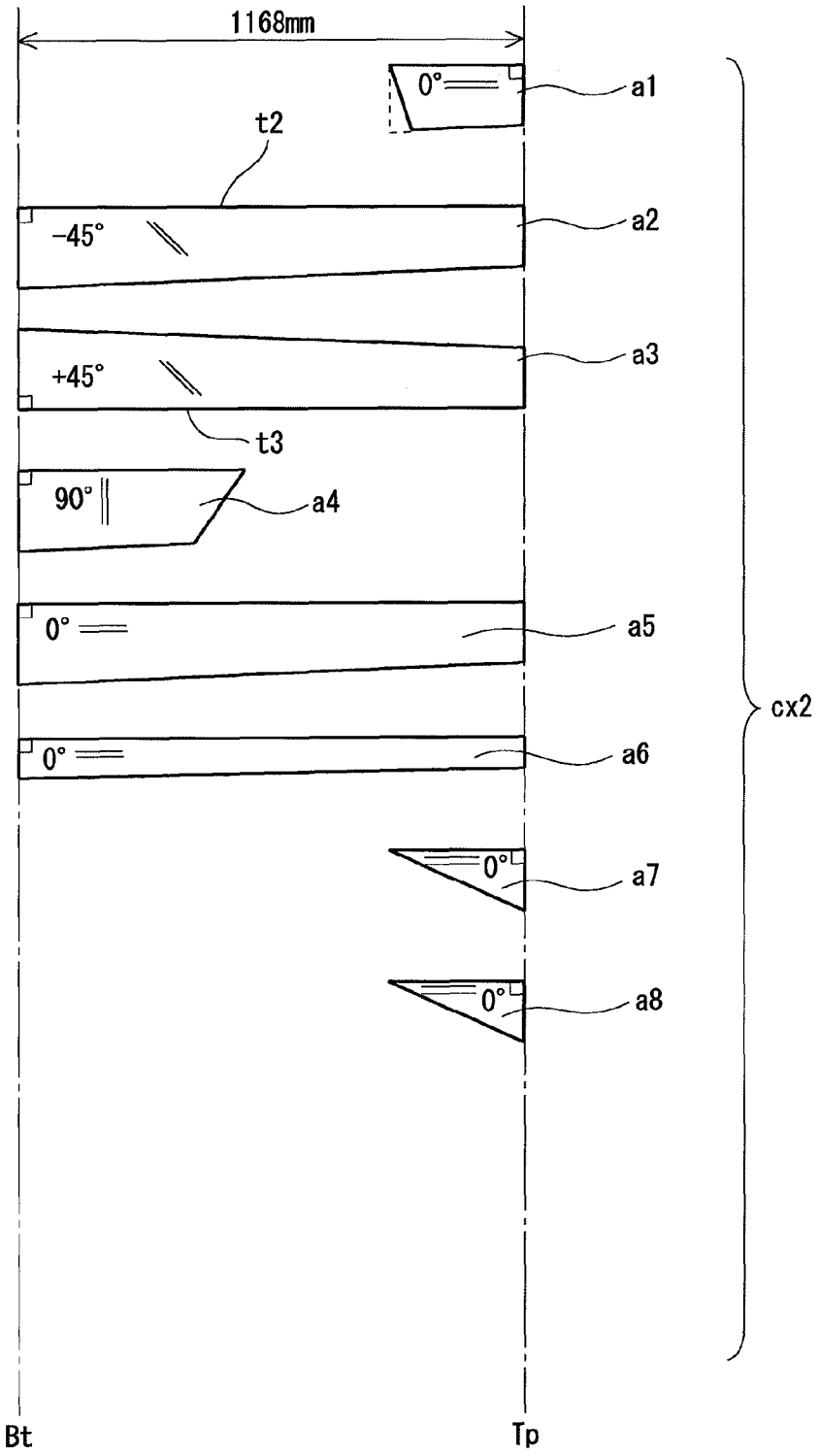
FIG. 7 is a developed view of comparative example 2.

FIG. 7 shows a laminate constitution of a shaft according to comparative example 2. In comparative example 2, the product name and the number of windings of each sheet were as follows.

Sheet a2: TR350C-150S (two plies)
Sheet a2: MR350C-100S (two plies)
Sheet a3: MR350C-100S (two plies)
Sheet a4: 805S-3 (two plies)
Sheet a5: MR350C-100S (two plies)
Sheet a6: MR350C-100S (one ply)
Sheet a7: TR350C-100S
Sheet a8: TR350C-100S A back end reinforcing bias layer was not used in comparative example 2. Only a back end reinforcing hoop layer was used as a back end reinforcing layer. The back end reinforcing hoop layer was a sheet a4. A shaft and a golf club according to comparative example 2 were obtained in the same manner as in example 1 except for above.

The evaluation results of these golf clubs are shown in the following Table 2.

TABLE 2

Specifications and evaluation results of examples and comparative examples

| | Example 1 | Example 2 | Example 3 | Comparative example 1 | Comparative example 2 |
|---|---|---|---|---|---|
| Back end reinforcing layer | Bias and hoop | Bias and hoop | Bias and hoop | Straight | Hoop |
| Absolute angle θa (degree) of back end reinforcing bias layer | 15 | 30 | 45 | — | — |
| Length L1 (mm) of back end reinforcing bias layer | 320 | 320 | 320 | — | — |
| Length L2 (mm) of back end reinforcing hoop layer | 320 | 320 | 320 | — | 400 |
| Flex point ratio C1 (%) | 40 | 40 | 40 | 50 | 55 |
| Torsional rigidity value GIt ($\times 10^6$ kgf · mm$^2$) | 4.2 | 4.5 | 4.7 | 3.0 | 3.0 |
| Three-point flexural strength of point C (kgf) | 120 | 125 | 130 | 70 | 100 |
| Operativity | 5.0 | 5.0 | 5.0 | 3.0 | 2.0 |
| Lateral variation | 4.0 | 4.5 | 5.0 | 2.0 | 2.0 |
| Lengthwise variation | 5.0 | 5.0 | 5.0 | 3.0 | 2.0 |

[Evaluation Methods]

[Three-Point Flexural Strength]

Figure 8:
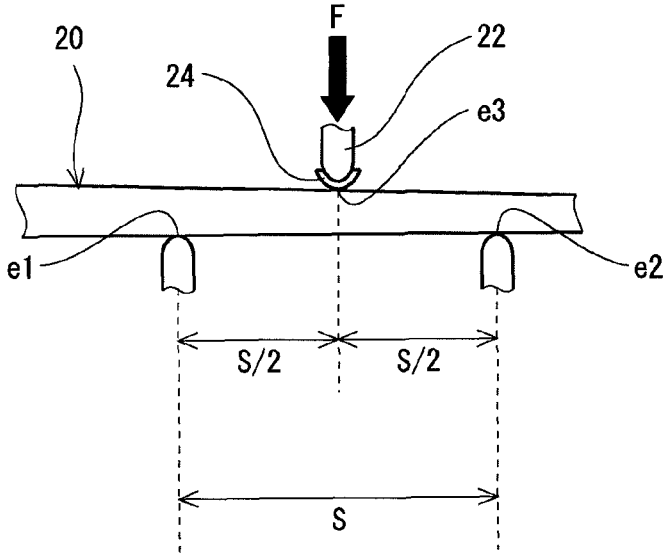
FIG. 8 shows a method for measuring a three-point flexural strength.

An SG type three-point flexural strength test was employed. This is a test set by Consumer Product Safety Association. FIG. 8 shows a measuring method of the SG type three-point flexural strength test. As shown in FIG. 8, an indenter 22 applies a load F downward from above at a load point e3 while a shaft 20 is supported from below at two supporting points e1 and e2. The load point e3 is placed at a position bisecting the distance between the supporting points e1 and e2. The descending speed of the indenter 22 is 20 mm/min. A silicone rubber 24 is attached to the tip of the indenter 22. The load point e3 is the measured point. The measured point was set to a point C. The point C is a point separated by 175 mm from a butt end Bt. A value (peak value) of the load F when the shaft 20 was broken was measured. The span S was set to 300 mm. The measurement results at the point C are shown in Table 2.

In order to calculate a flex point ratio C1, a forward flex F1 and a backward flex F2 were measured. The calculation formula of the flex point ratio C1 is described above.

[Forward Flex F1]

Figure 9A:
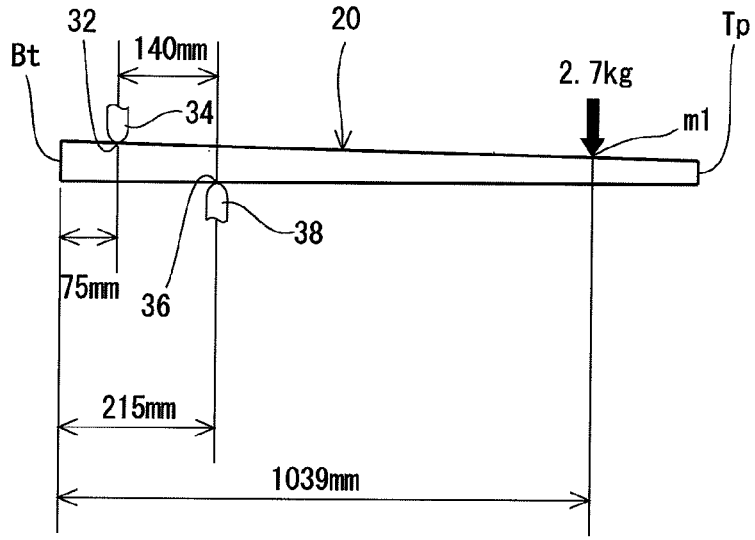
FIG. 9A shows a method for measuring a forward flex.

FIG. 9A is a view for describing a measuring method of the forward flex F1. As shown in FIG. 9A, a first supporting point 32 was set at a position which was 75 mm away from the butt end Bt. Furthermore, a second supporting point 36 was set at a position which was 215 mm away from the butt end Bt. A support 34 supporting the shaft 20 from the upside was provided at the first supporting point 32. A support 38 supporting the shaft 20 from the underside was provided at the second supporting point 36. In a state where no load was applied, the shaft axis line of the shaft 20 was substantially horizontal. At a load point m1 which was 1039 mm away from the butt end Bt, a load of 2.7 kg was allowed to act in a vertical downward direction. A travel distance (mm) of the load point m1 between the state where no load was applied and a state where a load was applied was determined as the forward flex F1. The travel distance is a travel distance along the vertical direction.

The section shape of a portion (hereinafter, referred to as an abutting portion) of the support 34 abutting on the shaft is as follows. The section shape of the abutting portion of the support 34 has convex roundness in a section parallel to the axis direction of the shaft. The curvature radius of the roundness is 15 mm. The section shape of the abutting portion of the support 34 has concave roundness in a section perpendicular to the axis direction of the shaft. The curvature radius of the concave roundness is 40 mm. The horizontal length (a length in a depth direction in FIG. 9) of the abutting portion of the support 34 is 15 mm in the section perpendicular to the axis direction of the shaft. The section shape of the abutting portion of the support 38 is the same as that of the support 34. The section shape of the abutting portion of a load indenter (not shown) applying a load of 2.7 kg at the load point m1 has convex roundness in the section parallel to the axis direction of the shaft. The curvature radius of the roundness is 10 mm. The section shape of the abutting portion of a load indenter (not shown) applying a load of 2.7 kg at the load point m1 is a straight line in the section perpendicular to the axis direction of the shaft. The length of the straight line is 18 mm. Thus, the forward flex F1 was measured.

[Backward Flex F2]

Figure 9B:
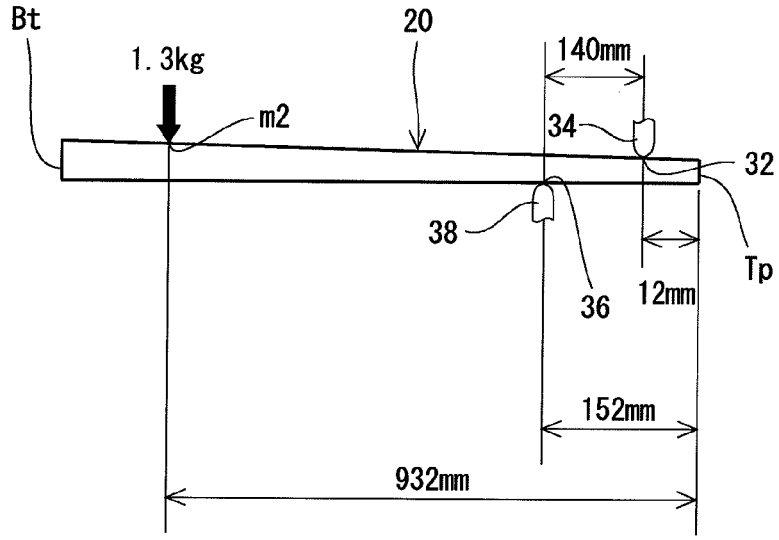
FIG. 9B shows a method for measuring a backward flex.

A measuring method of the backward flex is shown in FIG. 9B. The backward flex F2 was measured in the same manner as in the forward flex F1 except that the first supporting point 32 was set to a point separated by 12 mm from a tip end Tp; the second supporting point 36 was set to a point separated by 152 mm from the tip end Tp; a load point m2 was set to a point separated by 932 mm from the tip end Tp; and a load was set to 1.3 kg.

The flex point ratio C1 was calculated based on the forward flex F1 and the backward flex F2. The flex point ratio C1 is shown in the above-mentioned Table 2.

[Torsional Rigidity Value GIt]

Figure 10:
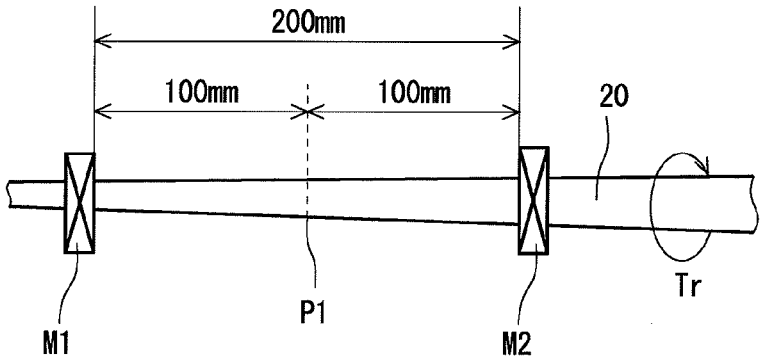
FIG. 10 shows a method for measuring a torsional rigidity value GIt.

A torsional rigidity value GIt of the above-mentioned point P1 was measured. FIG. 10 shows a measuring method of the torsional rigidity value GIt. A first position was fixed by a jig M1, and a second position separated by 200 mm from the jig M1 was held by a jig M2. The point P1 is a middle point between the above-mentioned first position and the above-mentioned second position. The torsional angle A (degree) of the shaft when a torque Tr of 139 (kgf·mm) [136.3 (N·cm)] was applied to the jig M2 was measured. The torsional rigidity value GIt was calculated by the following formula.

$$GIt(\text{kgf·mm}^2/\text{deg})=M\times Tr/A$$

M is a measuring span (mm); Tr is a torque (kgf·mm); and A is a torsional angle (degree). The measuring span M is 200 mm, and the torque Tr is 139 (kgf·mm). The torsional rigidity value GIt is shown in the above-mentioned table 2.

[Operativity]

Five testers hit balls with the club, and evaluated the operativity thereof. "XXIO SUPER XD" (trade name) manufactured by SRI Sports Limited. was used for the ball. A club having good operativity tends to provide a hit ball result intended by a golf player, and is easy to be swung. The evaluation was sensuous evaluation. The testers made five-stage evaluation on a scale of one to five. The higher the score is, the higher the evaluation is. The average of the five testers' evaluation scores is shown in the above-mentioned Table 2.

[Lateral Variation]

Five testers hit balls with the club, and evaluated lateral variation of a hit ball reaching point. The testers made five-stage evaluation on a scale of one to five. The higher the score is, the smaller the variation is. The average of the five testers' evaluation scores is shown in the above-mentioned Table 2.

[Lengthwise Variation]

Five testers hit balls with the club, and evaluated lengthwise variation (that is, variation of a flight distance) of a hit ball reaching point. The testers made five-stage evaluation on a scale of one to five. The higher the score is, the smaller the variation is. The average of the five testers' evaluation scores is shown in the above-mentioned Table 2.

Thus, the advantages of the present invention are apparent.

The method described above can be applied to golf club shafts.

The description hereinabove is merely for an illustrative example, and various modifications can be made in the scope not to depart from the principles of the present invention.

What is claimed is:

1. A golf club shaft comprising a plurality of layers, wherein the layers comprise a bias layer in which an absolute angle θa of a fiber to a shaft axis line is 10 degrees or greater and 70 degrees or less, and a hoop layer in which the angle θa is equal to or greater than 80 degrees;

the layers comprise a full length layer disposed all over in an axis direction of the shaft, and a partial layer partially disposed in the axis direction of the shaft;

the partial layer comprises a back end reinforcing bias layer and a back end reinforcing hoop layer a back end of the back end reinforcing bias layer is located at a butt end of the shaft, and a back end of the back end reinforcing hoop layer is located at the butt end of the shaft; and a torsional rigidity value GIt at a point separated by 300 mm from a butt end is $3.5\times10^6$ (kgf·mm$^2$/deg) or greater and $5.0\times10^6$ (kgf·mm$^2$/deg) or less.

2. The golf club shaft according to claim 1, wherein an axial length of the back end reinforcing bias layer is 120 mm or greater and 350 mm or less;

and an axial length of the back end reinforcing hoop layer is 120 mm or greater and 350 mm or less.

3. The golf club shaft according to claim 1, wherein an absolute angle θa of a fiber in the back end reinforcing bias layer is 20 degrees or greater and 45 degrees or less.

4. The golf club shaft according to claim 1, wherein the golf club shaft is manufactured by a manufacturing method comprising the steps of:

preparing a first back end reinforcing bias sheet;

preparing a second back end reinforcing bias sheet;

preparing a back end reinforcing hoop sheet;

stacking the first back end reinforcing bias sheet, the second back end reinforcing bias sheet, and the back end reinforcing hoop layer with the back end reinforcing hoop layer sandwiched between the first back end reinforcing bias sheet and the second back end reinforcing bias sheet, to obtain a united sheet; and winding the united sheet.

5. The golf club shaft according to claim 4, wherein a resin content of the back end reinforcing hoop sheet is greater than those of the first and second back end reinforcing bias sheets in the united sheet.

6. The golf club shaft according to claim 1, wherein a resin content Rb of the back end reinforcing bias layer is 15% by mass or greater and less than 24% by mass;

a thickness Tb of the back end reinforcing bias layer is 0.05 mm or greater and less than 0.15 mm;

a resin content Rf of the back end reinforcing hoop layer is 24% by mass or greater and 40% by mass or less; and a thickness Tf of the back end reinforcing hoop layer is 0.02 mm or greater and less than 0.10 mm.

7. The golf club shaft according to claim 1, wherein a back end reinforcing straight layer is absent.

8. The golf club shaft according to claim 1, wherein the number of windings of the back end reinforcing bias layer is 2 or greater and 6 or less.

9. The golf club shaft according to claim 1, wherein the number of windings of the back end reinforcing hoop layer is 1 or greater and 3 or less.

10. The golf club shaft according to claim 1, wherein a flex point ratio C1 defined by the following formula is 20% or greater and 50% or less:

$$C1=[F2/(F1+F2)]\times 100$$

wherein F1 is a forward flex (mm), and F2 is a backward flex (mm).

11. The golf club shaft according to claim 1, wherein a shaft weight is 35 g or greater and 65 g or less.

12. The golf club shaft according to claim 1, wherein a shaft length is 40 inch or greater and 48 inch or less.

* * * * *